US008029053B2

(12) United States Patent
Troutman et al.

(10) Patent No.: US 8,029,053 B2
(45) **Date of Patent: *Oct. 4, 2011**

(54) HIGH CHAIRS AND METHODS TO USE THE SAME

(75) Inventors: Damon Oliver Casati Troutman, Lake Forest, FL (US); Rapheal Torion Avila, Mundelein, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/979,027

(22) Filed: Dec. 27, 2010

(65) Prior Publication Data

US 2011/0089723 A1 Apr. 21, 2011

Related U.S. Application Data

(63) Continuation of application No. 12/494,760, filed on Jun. 30, 2009, now Pat. No. 7,883,145, which is a continuation of application No. 11/968,526, filed on Jan. 2, 2008, now Pat. No. 7,568,758.

(60) Provisional application No. 60/883,277, filed on Jan. 3, 2007.

(51) Int. Cl.
*A47B 83/02* (2006.01)
*A47D 15/00* (2006.01)

(52) U.S. Cl. ..... 297/148; 297/149; 297/182

(58) Field of Classification Search ..... 297/148, 297/149, 182

See application file for complete search history.

(56) References Cited

U.S. PATENT DOCUMENTS

| | | | |
|---|---|---|---|
| 337,147 | A | 1/1888 | Delaney |
| 1,008,456 | A | 11/1911 | Etter |
| 1,054,452 | A | 2/1913 | Sayen |
| 1,372,505 | A | 3/1921 | Henson |
| 1,724,569 | A | 8/1929 | Elliott |
| 2,281,813 | A | 5/1942 | Uline |
| 2,309,040 | A | 2/1945 | Grady |
| 2,418,259 | A | 4/1947 | Harmanson |
| 2,503,942 | A | 4/1950 | Engelberg et al. |
| 2,532,812 | A | 12/1950 | Huber |
| 2,599,610 | A | 6/1952 | Clairmonte et al. |
| 2,869,614 | A | 1/1959 | Wamsley |
| 2,935,122 | A | 5/1960 | Miller |
| 2,968,338 | A | 1/1961 | Reese |
| 3,185,523 | A | 5/1965 | Morrill |

(Continued)

FOREIGN PATENT DOCUMENTS

EP 0655379 5/1995

OTHER PUBLICATIONS

Office Action, issued by the United States Patent and Trademark Office on Sep. 25, 2008, in connection with U.S. Appl. No. 11/968,526, 10 pages.

(Continued)

*Primary Examiner* — Rodney B White
(74) *Attorney, Agent, or Firm* — Hanley, Flight & Zimmerman, LLC

(57) ABSTRACT

High chairs and methods to use high chairs are disclosed. An example high chair includes a frame and a seat, wherein the seat defines a slot and is shaped to funnel spills toward the slot.

19 Claims, 13 Drawing Sheets

U.S. PATENT DOCUMENTS 3,206,249 A 9/1965 Gateley
3,215,469 A 11/1965 Wamsley
3,383,134 A 5/1968 Webb et al.
3,490,808 A 1/1970 Siegel
3,611,457 A 10/1971 Wippich
3,630,570 A 12/1971 Swenson et al.
3,672,722 A 6/1972 Murcott
3,853,350 A 12/1974 Leffler
3,909,061 A 9/1975 Johnson
3,912,328 A 10/1975 Tanaka
3,988,789 A 11/1976 Blount
4,012,158 A 3/1977 Harper
4,025,372 A 5/1977 Fenton
4,165,127 A 8/1979 Vago
4,356,990 A 11/1982 Sakurada et al.
4,390,486 A 6/1983 Hendry et al.
4,391,453 A 7/1983 Glaser
4,445,661 A 5/1984 Langmesser et al.
4,451,082 A 5/1984 Giordani
4,466,662 A 8/1984 McDonald et al.
4,579,386 A 4/1986 Rupp et al.
4,592,562 A 6/1986 Stautnieks et al.
4,603,902 A 8/1986 Maloney
4,606,576 A 8/1986 Jones
4,616,877 A 10/1986 Slatt et al.
4,626,030 A 12/1986 Kassai
4,654,904 A 4/1987 Britz
4,655,471 A 4/1987 Peek
4,667,901 A 5/1987 Herndon
4,690,862 A 9/1987 Hoffmann
4,696,514 A 9/1987 Maloney
4,701,473 A 10/1987 Hasegawa et al.
4,714,292 A 12/1987 Kassai
4,722,570 A 2/1988 Bertoli
4,768,825 A 9/1988 Quinlan
4,789,179 A 12/1988 Takahashi
4,807,928 A 2/1989 Cone
4,819,958 A 4/1989 Perego
4,842,331 A 6/1989 Waples
4,861,109 A 8/1989 Leach
4,883,243 A 11/1989 Herndon
4,899,961 A 2/1990 Herndon
4,938,603 A 7/1990 Turner et al.
4,944,556 A 7/1990 Griesbaum et al.
4,953,913 A 9/1990 Graebe
4,955,922 A 9/1990 Terauchi
4,958,885 A 9/1990 Kassai
4,962,965 A 10/1990 Glover
4,968,092 A 11/1990 Giambrone
5,031,962 A 7/1991 Lee
5,042,878 A 8/1991 Collins
5,056,869 A 10/1991 Morrison
5,071,190 A 12/1991 Tame
5,118,161 A 6/1992 Slowe et al.
5,154,487 A 10/1992 Warburton
5,160,184 A 11/1992 Faiks et al.
5,183,311 A 2/1993 Meeker et al.
5,238,292 A 8/1993 Golenz et al.
5,238,622 A 8/1993 Grimmer
5,275,462 A 1/1994 Pond et al.
5,282,670 A 2/1994 Karslen et al.
5,286,085 A 2/1994 Minami
5,320,412 A 6/1994 Eakins et al.
5,328,242 A 7/1994 Steffens et al.
5,364,137 A 11/1994 Shimer
5,438,737 A 8/1995 Anscher et al.
5,445,432 A 8/1995 Chien
5,468,046 A 11/1995 Weber et al.
5,489,138 A 2/1996 Mariol et al.
5,503,461 A 4/1996 Schreier
5,507,550 A 4/1996 Maloney
5,509,719 A 4/1996 Cone
5,511,441 A 4/1996 Arai
5,512,319 A 4/1996 Cook et al.
5,527,090 A 6/1996 Cone
5,531,493 A 7/1996 Reynolds
5,547,245 A 8/1996 Knouse
5,547,256 A 8/1996 D'Antuono et al.
5,577,802 A 11/1996 Cowan et al.
5,580,132 A 12/1996 Rediske
5,582,462 A 12/1996 Shea
5,582,464 A 12/1996 Maymon
5,586,810 A 12/1996 Liu
5,613,734 A 3/1997 Michael et al.
5,669,664 A 9/1997 Perego
5,669,666 A 9/1997 Lee
5,687,436 A 11/1997 Denton
5,690,387 A 11/1997 Sarti
5,707,104 A 1/1998 Perego
5,749,627 A 5/1998 Perego
5,779,306 A 7/1998 Ohlsson
5,786,394 A 7/1998 Slaven
5,810,432 A 9/1998 Haut et al.
5,820,207 A 10/1998 Wang
5,823,615 A 10/1998 Haut
5,850,645 A 12/1998 Ogawa et al.
5,868,471 A 2/1999 Graham et al.
5,890,769 A 4/1999 Fairbanks
5,908,223 A 6/1999 Miller
5,921,626 A 7/1999 Baker
5,922,256 A 7/1999 Gallagher et al.
5,951,102 A 9/1999 Poulson et al.
5,988,744 A 11/1999 Franchak
5,992,932 A 11/1999 Kain et al.
5,997,091 A 12/1999 Rech et al.
6,024,412 A 2/2000 Kain et al.
6,033,019 A 3/2000 Hession-Kunz et al.
6,050,643 A 4/2000 Kain et al.
6,089,653 A 7/2000 Hotaling et al.
6,089,654 A 7/2000 Burstein
6,126,236 A 10/2000 Wu
6,130,106 A 10/2000 Zimlich
6,139,106 A 10/2000 Aldridge
6,161,898 A 12/2000 Brevi
6,220,668 B1 4/2001 Scheffzuck
6,226,819 B1 5/2001 Ogawa et al.
6,250,716 B1 6/2001 Clough
6,280,666 B1 8/2001 Gallagher et al.
6,293,623 B1 9/2001 Kain et al.
6,346,833 B1 2/2002 Kuroki
6,367,879 B1 4/2002 Chen et al.
6,398,304 B1 6/2002 Chen et al.
6,416,124 B1 7/2002 Chen et al.
6,419,312 B1 7/2002 Flannery et al.
6,467,846 B2 10/2002 Clough
6,478,377 B2 11/2002 Kassai et al.
6,543,847 B2 4/2003 Balensiefer
6,578,496 B2 6/2003 Guard et al.
6,666,505 B2 12/2003 Greger et al.
6,666,516 B2 12/2003 Grammss
6,666,517 B2 12/2003 Clough
6,692,070 B1 2/2004 Hou et al.
6,715,827 B1 4/2004 Chen
6,716,379 B2 4/2004 Stimler et al.
6,736,454 B1 5/2004 Sardo
6,746,075 B2 6/2004 Cheng et al.
6,761,403 B2 7/2004 Pal et al.
6,783,177 B1 8/2004 Nakans
6,851,375 B2 2/2005 Guard et al.
6,863,350 B1 3/2005 McCulley et al.
6,893,096 B2 5/2005 Bonn et al.
6,896,326 B2 5/2005 Chen
6,899,394 B2 5/2005 Wang
6,942,299 B1 9/2005 Sardo
6,951,371 B2 10/2005 Wang
7,029,064 B2 4/2006 Chen
7,040,705 B2 5/2006 Clough
7,066,542 B2 6/2006 Wang
7,080,418 B2 7/2006 Henegar
7,080,886 B2 7/2006 Bauer
7,104,603 B2 9/2006 Keegan et al.
7,117,568 B2 10/2006 Nolan
7,128,367 B2 10/2006 You et al.
7,568,758 B2 8/2009 Troutman et al.
7,597,390 B2 10/2009 Galati, Jr. et al.
7,637,564 B1 12/2009 Schroeder et al.
7,883,145 B2 * 2/2011 Troutman et al. ..... 297/148

| | | | |
|---|---|---|---|
| 2004/0026976 | A1 | 2/2004 | Chen et al. |
| 2004/0070238 | A1 | 4/2004 | Moser et al. |
| 2004/0124678 | A1 | 7/2004 | Williams et al. |
| 2004/0212225 | A1 | 10/2004 | Chen |
| 2004/0217639 | A1 | 11/2004 | Clough |
| 2005/0006930 | A1 | 1/2005 | Nolan et al. |
| 2005/0082888 | A1 | 4/2005 | Williams et al. |
| 2005/0121963 | A1 | 6/2005 | Williamson et al. |
| 2005/0126445 | A1 | 6/2005 | Guard et al. |
| 2005/0127722 | A1 | 6/2005 | Longenecker et al. |
| 2005/0146168 | A1 | 7/2005 | Nolan |
| 2005/0146183 | A1 | 7/2005 | Langmaid et al. |
| 2005/0184573 | A1 | 8/2005 | Stone et al. |
| 2005/0269857 | A1 | 12/2005 | Buis |
| 2006/0066142 | A1 | 3/2006 | Nolan et al. |
| 2006/0131944 | A1 | 6/2006 | Helmond |
| 2006/0220349 | A1 | 10/2006 | Wolf et al. |
| 2006/0232112 | A1 | 10/2006 | Karr |
| 2007/0085388 | A1 | 4/2007 | Nolan et al. |
| 2007/0096527 | A1 | 5/2007 | Nolan et al. |
| 2007/0096528 | A1 | 5/2007 | Nolan et al. |
| 2007/0108827 | A1 | 5/2007 | Clough |
| 2008/0185880 | A1 | 8/2008 | Romaniuk |
| 2008/0185881 | A1 | 8/2008 | Romaniuk et al. |
| 2009/0179478 | A1 | 7/2009 | Frady |
| 2009/0212606 | A1 | 8/2009 | Bunch |
| 2010/0038938 | A1 | 2/2010 | Feinstein |

OTHER PUBLICATIONS

Notice of Allowance and Fee(s) Due, issued by the United States Patent and Trademark Office on Apr. 3, 2009, in connection with U.S. Appl. No. 11/968,526, 9 pages.

"PCT International Search Report and Written Opinion of the International Searching Authority,"issued by the International Searching Authority on September, in connection with the international application No. PCT/US08/50116, 11 pages.

"PCT International Preliminary Report on Patentability," issued by the International Searching Authority on September, in connection with the international application No. PCT/US08/50116, 7 pages.

Office Action, issued by the United States Patent and Trademark Office on Feb. 25, 2010, in connection with U.S. Appl. No. 12/494,760, 10pages.

Final Office Action, issued by the United States Patent and Trademark Office on Sep. 10, 2010, in connection with U.S. Appl. No. 12/494,760, 12 pages.

Notice of Allowance and Fee(s) Due, issued by the United States Patent and Trademark Office on Dec. 1, 2010, in connection with U.S. Appl. No. 12/494,760, 4 pages.

* cited by examiner

HIGH CHAIRS AND METHODS TO USE THE SAME

RELATED APPLICATION

This patent is a continuation of U.S. patent application Ser. No. 12/494,760, now U.S. Pat. No. 7,883,145, entitled "High Chairs and Methods to Use High Chairs," filed on Jun. 30, 2009, which is a continuation of U.S. patent application Ser. No. 11/968,526, now U.S. Pat. No. 7,568,758, entitled "High Chairs and Methods to Use High Chairs," filed on Jan. 2, 2008, which claims priority to U.S. Provisional Patent Application No. 60/883,277, entitled "High Chairs and Methods to Use High Chairs," filed on Jan. 3, 2007, all of which are hereby incorporated by reference in their entireties.

FIELD OF THE DISCLOSURE

This disclosure relates generally to child care products, and, more particularly, to high chairs and methods to use high chairs.

BACKGROUND

Small children are typically placed into high chairs that secure and support the child when, for example, the child is being fed. Such high chairs typically include a seat attached to a frame and a tray attached to either the seat or the frame. The seats in conventional high chairs are typically fixed in one position so that the seat is elevated above a floor to a level that is convenient for an adult to feed the child from the adult's sitting position. At times it would be convenient for a parent or other caretaker to adjust the position of the seat on a high chair. Prior attempts at creating adjustable chairs have focused on making the height of the seat variable with respect to the floor.

Conventional high chairs also include trays that can be affixed and removed from the front of the seat. The trays provide a serving surface for providing the child with food, drinks and other items such as eating utensils and/or toys. In addition, the trays may include a tray insert that can be easily removed to clean spills that end up on the tray.

DETAILED DESCRIPTION

Figure 13A:
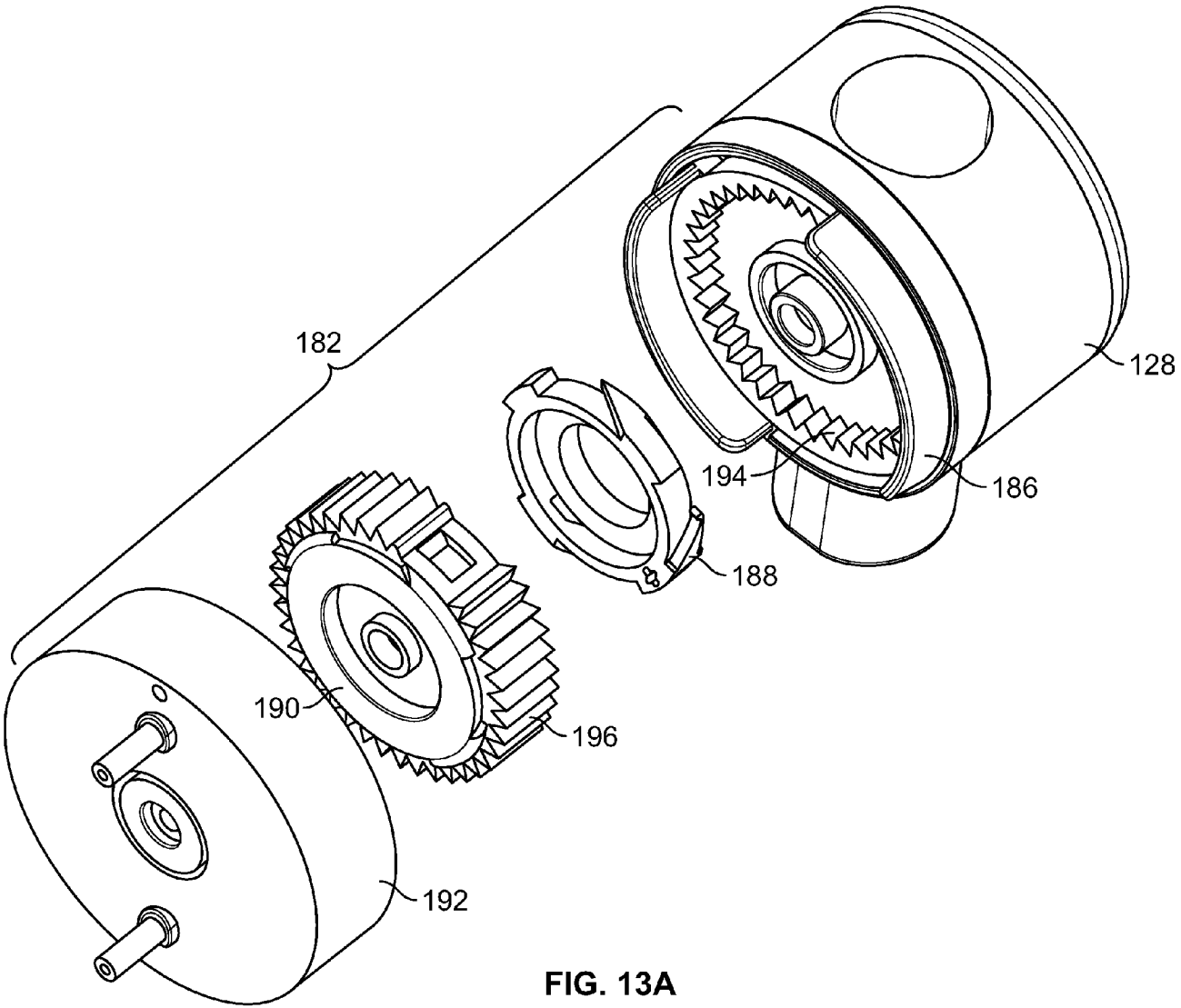
FIG. 13A is an exploded, left perspective view of an example rotating joint used to recline the example seat of FIG. 1.
Figure 13B:
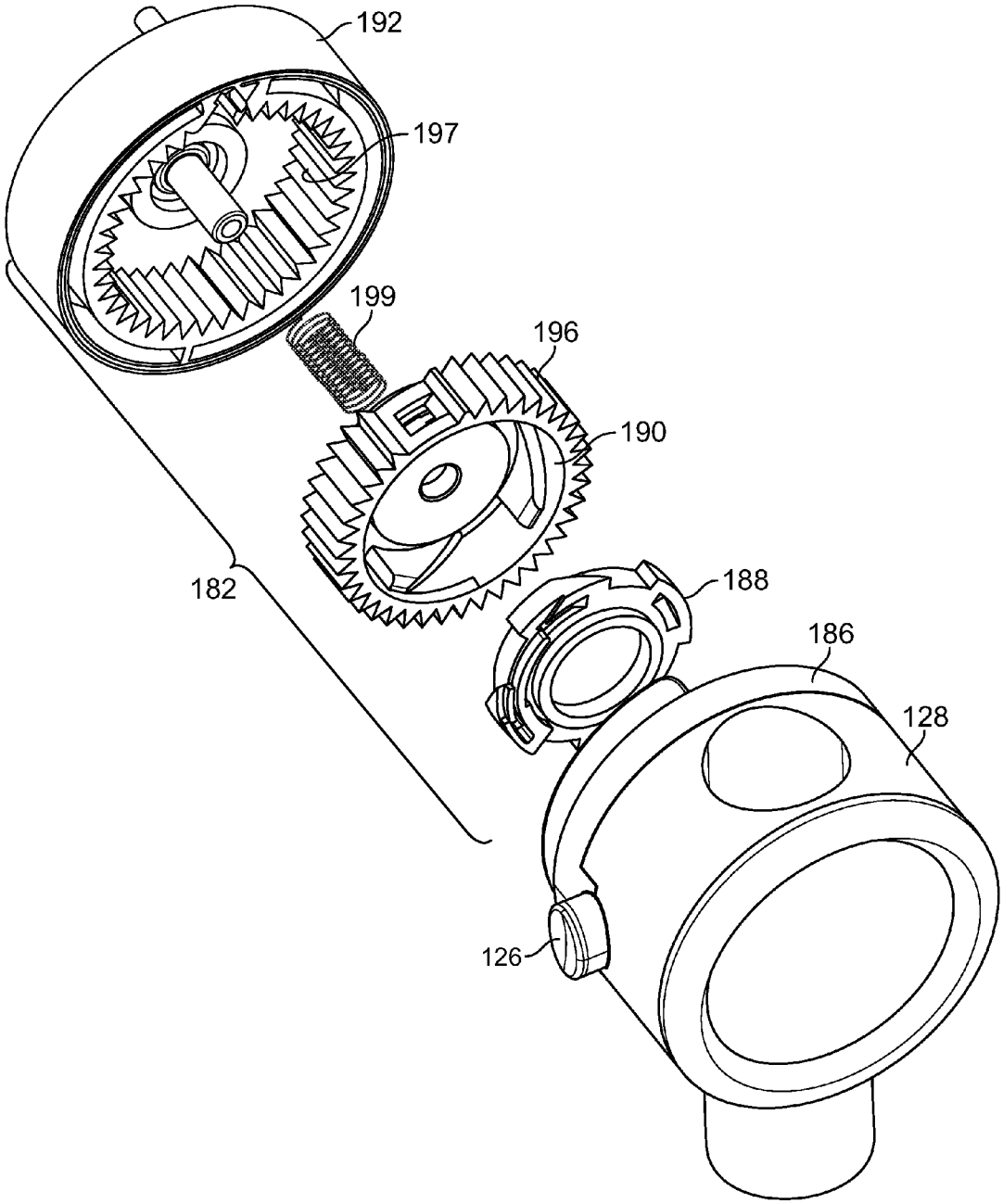
FIG. 13B is an exploded, right perspective view of an example rotating joint used to recline the example seat of FIG. 1.
Figure 14:
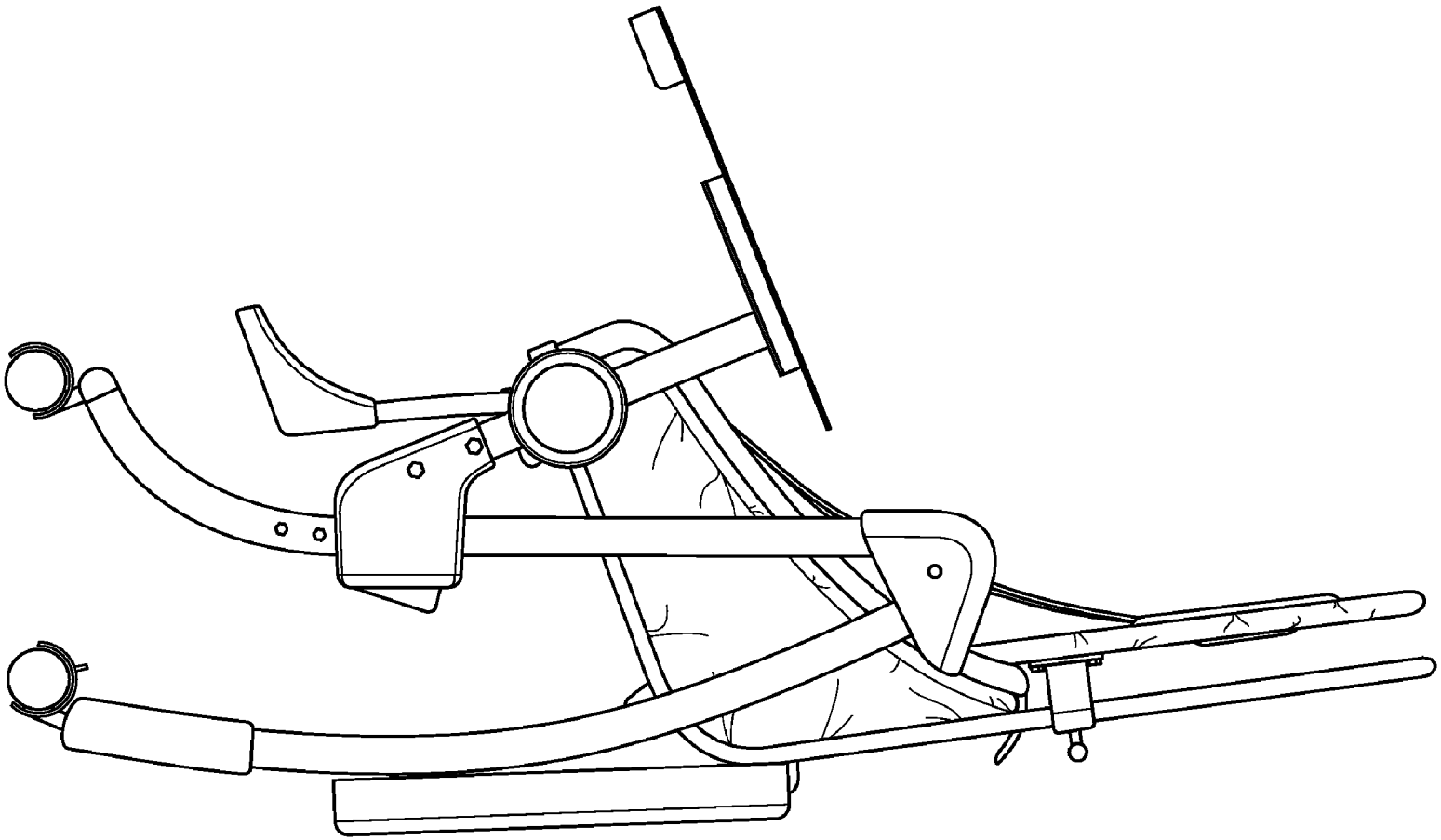
FIG. 14 is a side view of the high chair of FIG. 1, showing the chair in a folded position.

FIGS. 1-14 illustrate an example high chair 100 that is adjustable in several respects. The example high chair 100 of FIG. 1 may be fit to a child of virtually any size, and may be adjusted to a child as he/she grows over time. For example, a seat 102 and a tray 104 of the high chair 100 are adjustable along a frame 106 of the high chair 100. In addition, the distance between the seating surface of the seat 102 and the tray 104 is adjustable. Furthermore, the seat 102 may be reclined with respect to the frame 106. The high chair 100 also includes an adjustable headrest 108 and an adjustable footrest 110. The tray 104 is laterally adjustable with respect to a back 112 of the seat 102. The seat back 112 may be raised or lowered to properly position the headrest 108 relative to the child. In addition, the frame 106 may be collapsed into a folded position, as shown in FIG. 14.

Figure 1:
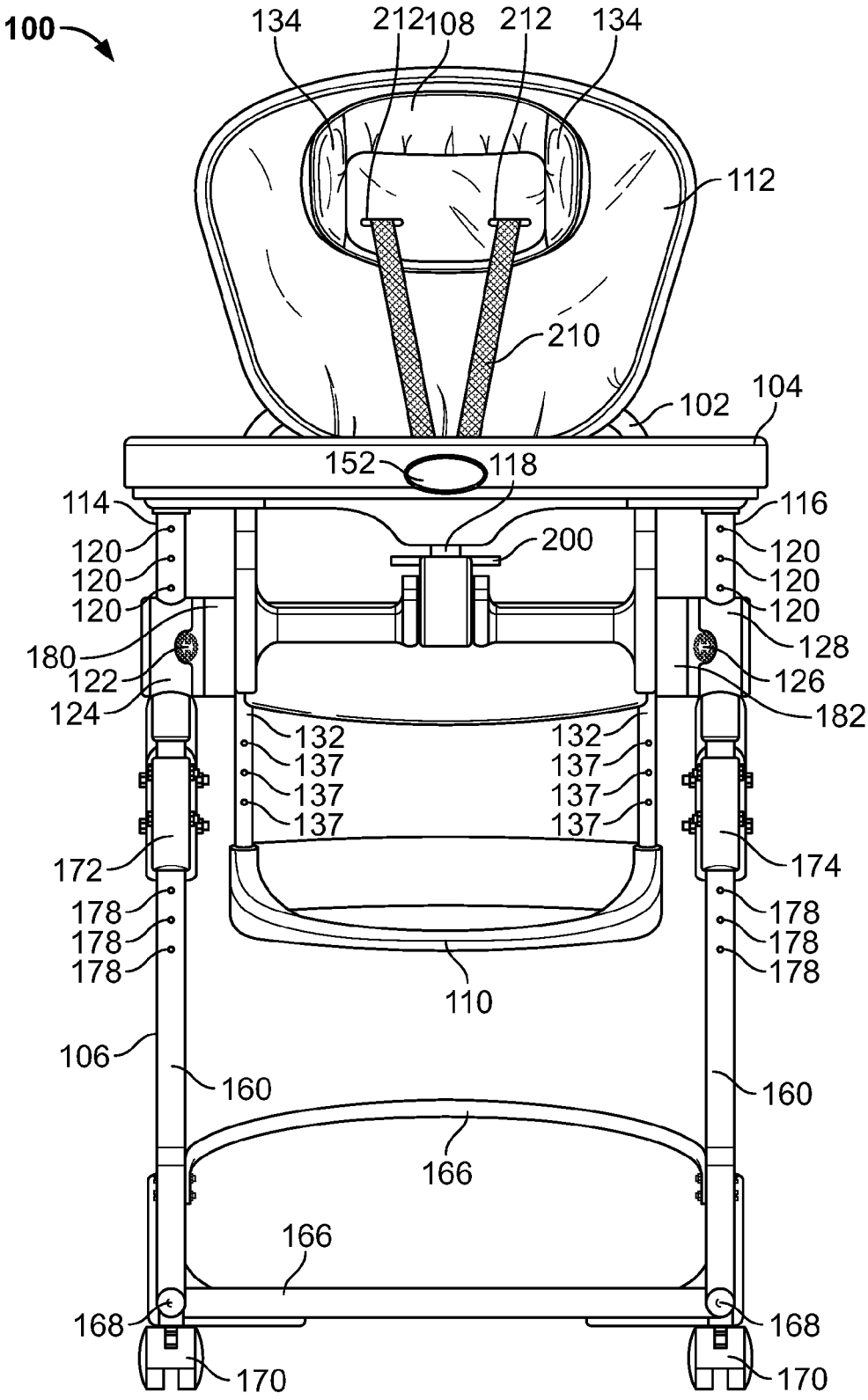
FIG. 1 is a front perspective view of an example high chair showing the chair in an upright position with an example headrest in an extended position.
Figure 2:
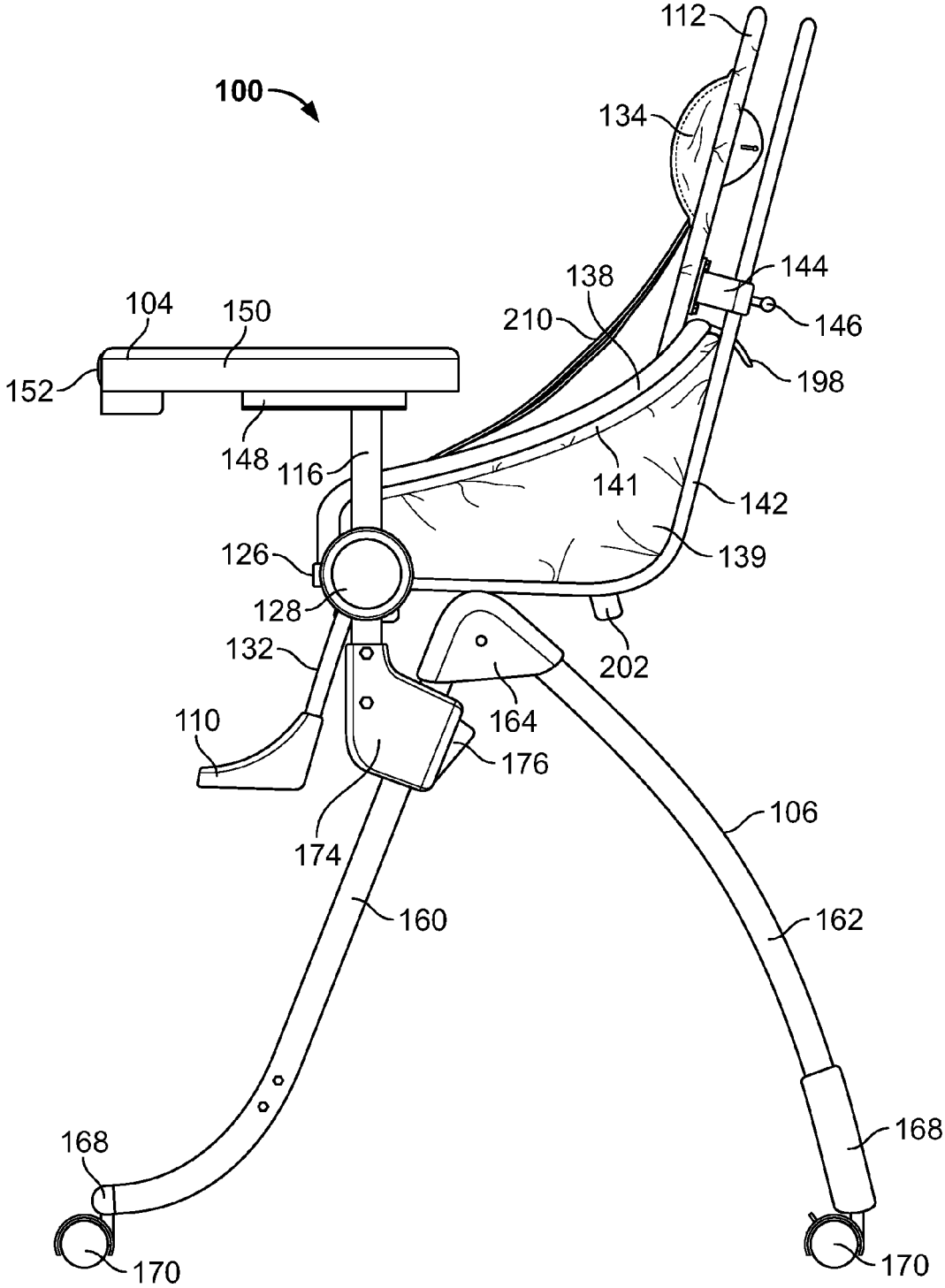
FIG. 2 is a side view of the example high chair of FIG. 1.

More specifically, FIGS. 1 and 2 show the example high chair 100 with the tray 104 positioned a first distance above the seating surface of seat 102. The distance between the tray 104 and the seat 102 as can be seen by comparing FIGS. 2 and 3 (the tray 104 is at a higher position above the seat 102 in FIG. 3). In the illustrated example, the tray 104 is coupled to the seat 102 through a first side post 114 and a second side post 116. Each side post 114, 166 is located toward a side of the seat 102 and tray 104. The seat 102 and tray 104 also are coupled through a crotch post 118. The crotch post 118 serves as a child restraint. Each of the first side post 114 and the second side post 116 includes a plurality of indentations, apertures or holes 120. A first connector 124 slidably couples the first side of the tray 104 to the first post 114. A second connector 128 slidably couples the tray 104 to the second post 116. A first actuator 122 is located on the first slidable connector 124, and a second actuator 126 is located on the second slidable connector 128. Each actuator 122, 126 is capable of selectively releasing a corresponding pin 130 (FIG. 4) from one of the holes 120. When both actuators 122, 126 are actuated, the first slidable connector 124 and the second slidable connector 128 are free to slide along the first side post 114 and the second side post 116, respectively. Although two actuators are shown in the illustrated example, any number of actuators may be used (e.g., only one of the first actuator 122 or the second actuator 126 may be included). A cross-sectional view of one of the connector 128 is shown in FIG. 4. In the illustrated example, the connectors 124, 128 are identical or mirror images of each other and, thus, only one connector 128 is shown and described in detail.

To move the seat 102 with respect to the tray 104, the first actuator 122 and the second actuator 126 are depressed against the force of a spring 129 (see FIG. 4) to cause a side pin 130 to disengage a respective one of the plurality of indentations or holes 120 of the posts 114, 116. In the illustrated example, a flange 131 of the actuator 126 is moved to engage (e.g., cam) the side pin 130 when the actuator 126 is depressed to thereby cause the pin 130 to rotate out of engagement with the hole 120.

As noted above, the connectors 124, 128 and the actuators 122, 126 are substantially identical, thus, there is a side pin 130 associated with each of the first and second actuators 122, 126. With the side pins 130 disengaged from holes 120, the first and second slidable connectors 124, 128 may be moved along the first and second posts 114, 116, respectively to a desired position. Movement of the first and second slidable connectors 124, 128 along the first and second posts 114, 116 changes the distance between the seat 102 and the tray 104. The first and second slidable connectors 124, 128 may be moved to a lower position on the first and second side posts 114, 116 to fit a larger and/or older child in the high chair 100, and the first and second slidable connectors 124, 128 may be moved to a higher position on the first and second side posts 114, 116 to fit a smaller and/or younger child in the high chair 100.

Furthermore, as the first and second slidable connectors 124, 128 move along the first and second side posts 114, 116, the seat 102 moves along the crotch post 118. In some examples, the crotch post 118 may telescope. When the seat 102 is in a desired position with respect to the tray 104, the first and second actuators 122, 126 are released such that the pins 130 move under the influence of their respective springs 129 and engage with respective ones of the plurality indentations or holes 120 to fix the seat 102 at a distance below the tray 104. In the example of FIGS. 1, 2 and 4, the tray 104 is fixed at the top of the posts 114, 116 and the seat 102 is adjustable to different positions along the posts 114, 116.

Figure 5:
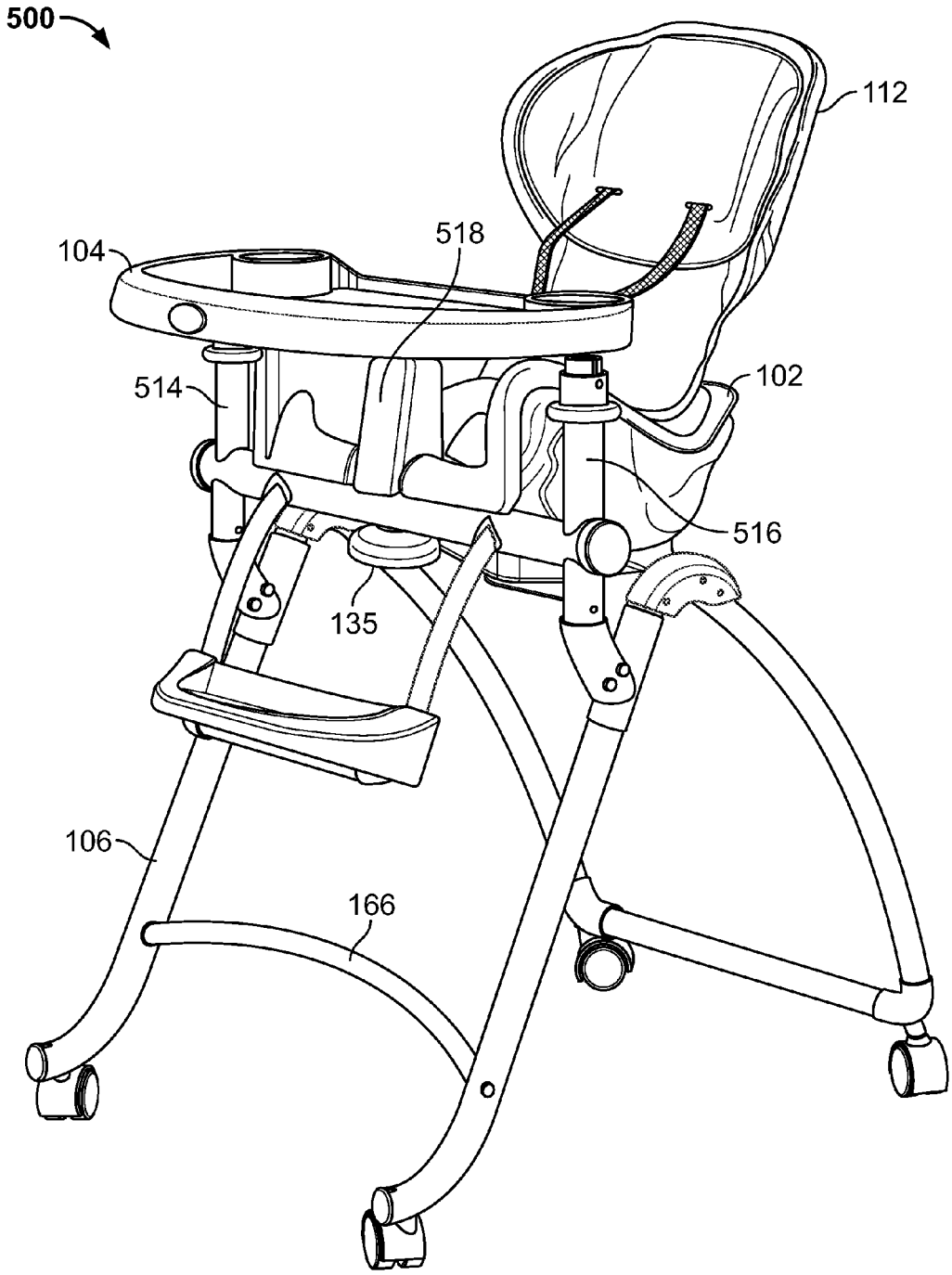
FIG. 5 is a front perspective view of an alternative example high chair with an example threaded connector to change the distance between the example seat and the example tray.

In an alternative example shown in FIG. 5, the seat 102 is height adjustable relative to the tray 104 in a different manner. In the example of FIG. 5, the tray 104 of the illustrated high chair 500 is fixed on the top of the side posts 514, 516. The seat 102 is slidably mounted to the crotch post 518 via the alternative actuator 135. In this example, the actuator 135 is a knob that is threaded on the crotch post 518. By rotating the actuator 135 (i.e., the threaded knob 135 shown in FIG. 5) beneath the seat 102 at the center of the chair 500, the seat 102 is moved up or down (depending on the direction of rotation of the knob 135) relative to the crotch post 518 and, thus, relative to the tray 104 to thereby adjust the distance between the seat 102 and the tray 104. As a result of this structure, one control is used to threadingly adjust the position of the seat 102 relative to the tray 104. The range of travel of the seat 102 relative to the tray 104 in the example of FIG. 5 is may be about one inch, although other ranges of travel would likewise be appropriate.

Referring back to FIGS. 1 and 2, the example high chair 100 also includes the adjustable footrest 110. The footrest 110 of the illustrated example is coupled to one or more extension posts 132. The footrest 110 is couplable to the extension posts 132 at different positions. As a result, the distance between the seat 102 and the footrest 110 is variable and may be changed to accommodate children of varying heights. The footrest 110 may be coupled to the extension posts 132 through any type of fasteners including, for example, Valco® pins and/or actuators and pins similar to the first and second actuator 122, 126 and pins 130 described above. In the illustrated example, springs loaded pins are used to engage apertures or holes 137 found in the posts 132. Four height adjustment positions 137 are shown in the illustrated example. However, any number of height adjustment positions may be included. In addition, the distance of travel between each height adjustment and/or the overall range of travel of the footrest may be any desired distance. For example, each height adjustment position may be an inch from an adjacent height adjustment, and the overall range of travel may be, for example, four inches.

Figure 3:
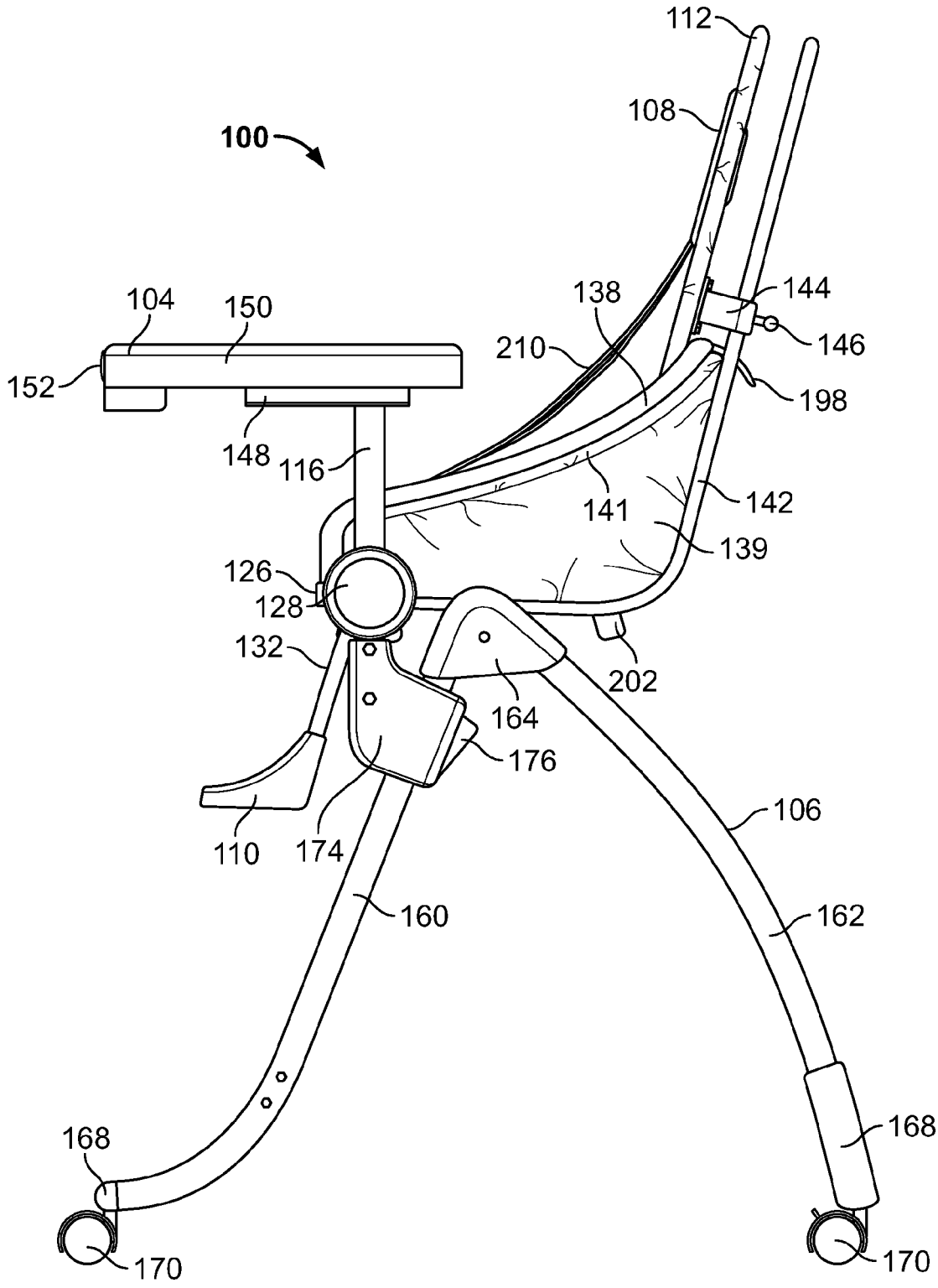
FIG. 3 is a side view of the example high chair of FIG. 1 with the example tray extended away from the example seat and the example headrest in a retracted position.
Figure 4:
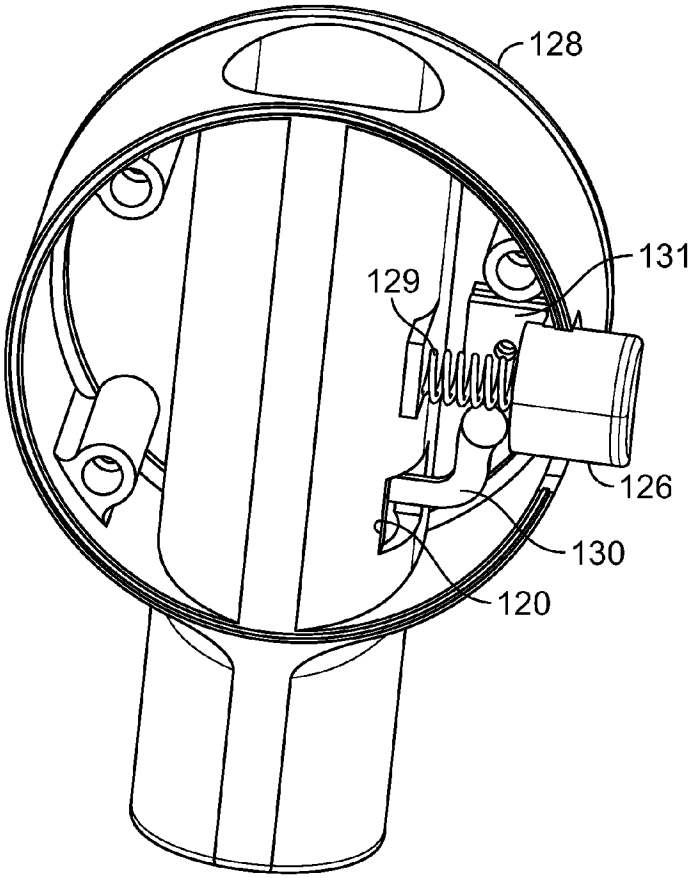
FIG. 4 is a partial cross-sectional view of an example slidable connector used to change the distance between the example seat and the example tray of FIG. 1.

As shown in FIGS. 1-3 and 6, the example high chair 100 also includes the adjustable bolster or headrest 108. FIGS. 1 and 2 show the headrest 108 in a deployed or extended position (i.e., with the bolster wings 134 of the headrest 108 at least partially pivoted forward). FIG. 3 shows the headrest 108 in a retracted position (i.e., with the wings 134 of the head rest 108 pivoted flat against the back 112). The foldable wings 134 pivot outward (away from the seat back) to support a small child's head, for example, during feeding, etc. In the illustrated example, at least a portion of the wings 134 extends to a rear of the seat 102. A bolster actuator 136 (FIG. 6) located on the rear of the seat 102 is used to retract and/or extend the one or more wings 134. In the illustrated example, the bolster actuator 136 is an elongated lever or paddle, which, when moved to a deployed position, forces (e.g., cams) the one or more wings 134 outward to an extended position in which the one or more wings 134 are folded outward and able to support the head of a child. The bolster actuator 136 may also be moved to a retracted position to pull the wings 134 to an unfolded position in which the wings 134 are flattened against the front of the seat 102. In the illustrated example, the bolster actuator 136 may be moved to one or more intermediate positions between the deployed position and the retracted position to move the wings 134 to semi-folded positions.

The illustrated example includes an upholstered the headrest 108. The headrest 108 also includes padding to form a cushion or pillow. Alternatively, the headrest 108 may be un-upholstered and/or may be upholstered together with the seat 102. Also, in some examples, the headrest 108 may not include foldable wings.

Figure 7:
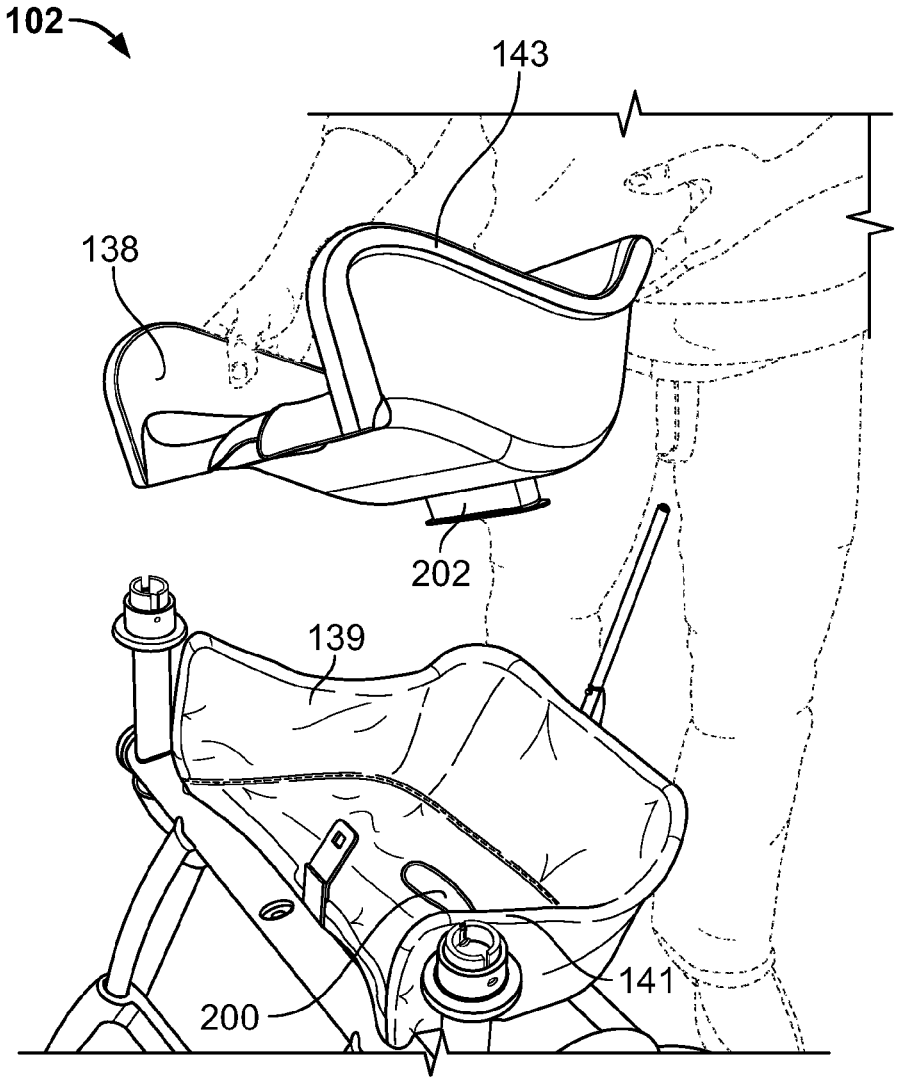
FIG. 7 is an exploded view of the example seat of FIG. 1.

In the illustrated example high chair 100 as shown in FIGS. 2, 3, 7 an 8, the seat 102 includes a seat pan 138, a seat support structure 139, a seat back 112, and a seat frame 142. The seat support 139 may be a fabric seat support such as, for example, mesh, or the seat support 139 may be a plastic component or any other suitable material. The seat support 139 of the illustrated example is fabric and includes a seat support frame 141. In some examples only the seat support frame 141 supports the seat 102, and no fabric support 139 is included. In this example, the frame 141 is implemented as a metal tube frame. The seat support 139 may be coupled to the seat frame 142 via any suitable mechanical or chemical fasteners.

Figure 8:
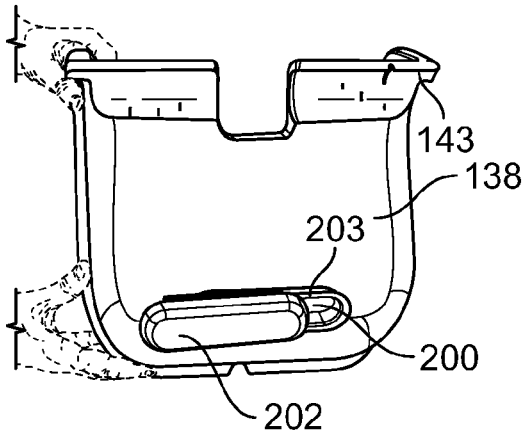
FIG. 8 is a bottom view of the example seat showing an example catch basin.

In the example of FIGS. 7-8, the seat pan 138 is supported in the seat support 139 via a lip 143 that is integrally formed with the seat pan 138. The lip 143 is sized to fit over and support the seat pan 138 on the seat support frame 141 of the seat support 139. In the illustrated example, the seat pan 138 is removably coupled to the seat support 139. Therefore, the seat pan 138 may be removed from the high chair 100 for cleaning, storage or the like.

The seat pan 138 of the illustrated example high chair comprises a slick polyurethane foam seat. The seat pan 138 is molded as a unitary structure and forms a slick, spill resistant, surface during the molding process. The seat pan 138 is easy to clean and is soft to the touch.

Figure 6:
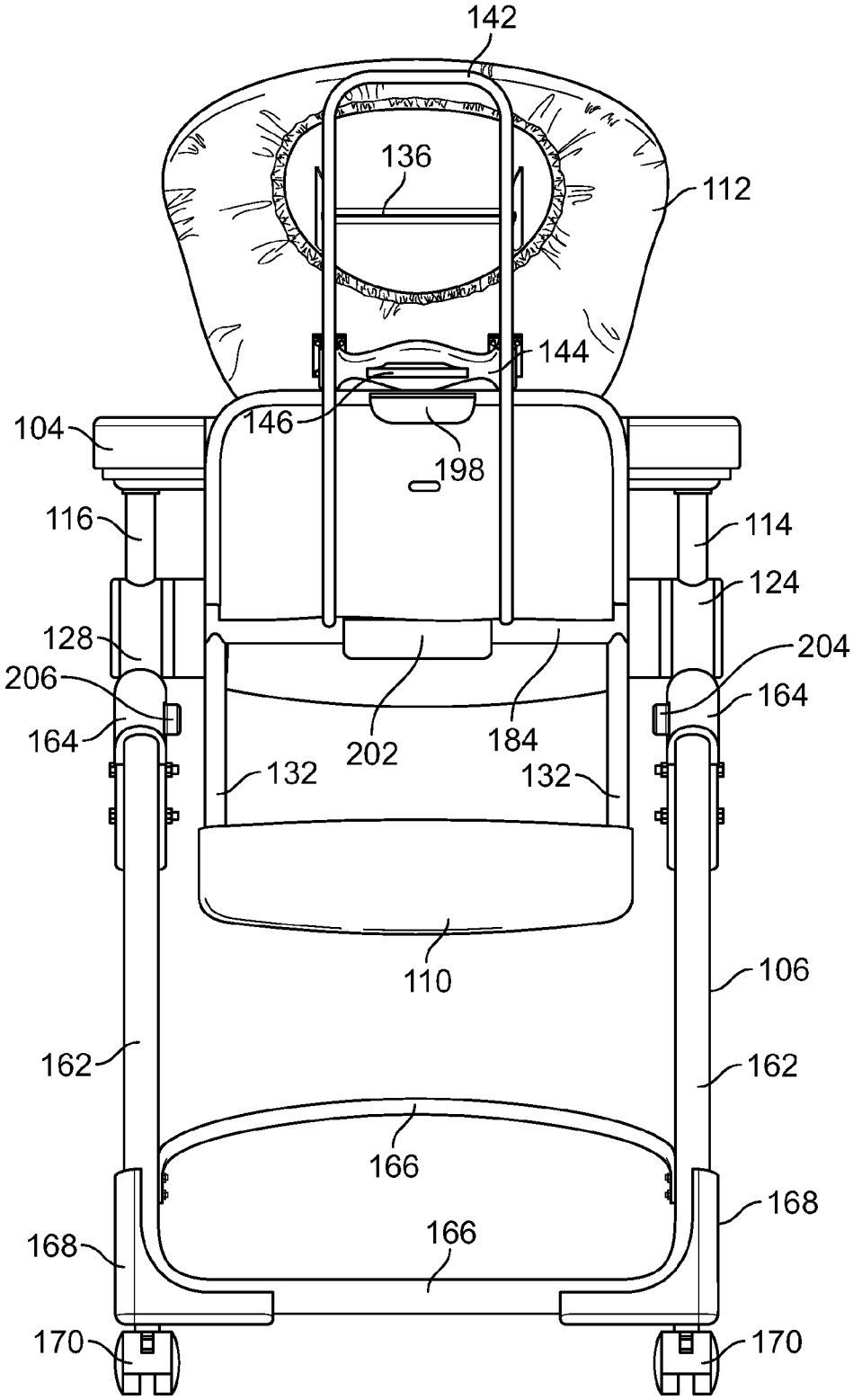
FIG. 6 is a rear view of the high chair of FIG. 1.

In the illustrated example, the height of the seat back 112 is adjustable. As shown in FIGS. 2, 3 and 6, there is a clamp 144 disposed on the rear of the seat back 112 to slidably couple the seat back 112 to the seat frame 142, a portion of which, as shown in FIG. 6, forms a U-shaped post. This portion may be a separate component from the remainder of the frame 142, i.e., not integrally formed therewith. The clamp 144 includes a seat back actuator 146, which may be implemented by any suitable actuating device such as, for example, a knob, push button, lever, etc. When the seat back actuator 146 is activated, the clamp 146 is released from the seat frame 142 and the seat back 112 may be raised or lowered with respect to the seat pan 138 to accommodate children of varying sizes. When the seat back 112 has been moved to a desired position, the seat back actuator 146 is returned to a locked position to fix the position of the seat back 112 to a particular position relative to the seat frame 142. In some examples, the seat back actuator 146 may causes the clamp 144 to engage one or more of a plurality of holes (not shown) on the frame 142 via a pin and spring connection similar to the other pin and spring connections described herein. In other examples, the clamp 144 maybe slidably moved to any of an infinite number of positions along the frame 142 and secured to the frame 142 via a friction fit. Adjusting the position of the seat back 112 enables the headrest 108 to be positioned to suit the child. The chair 100, thus, can grow with the child. In addition, adjusting the height of the seat back 112 adjusts the position of the child restraint 210 to properly conform to the height of the shoulder of a child seated in the chair 100.

Figure 9:
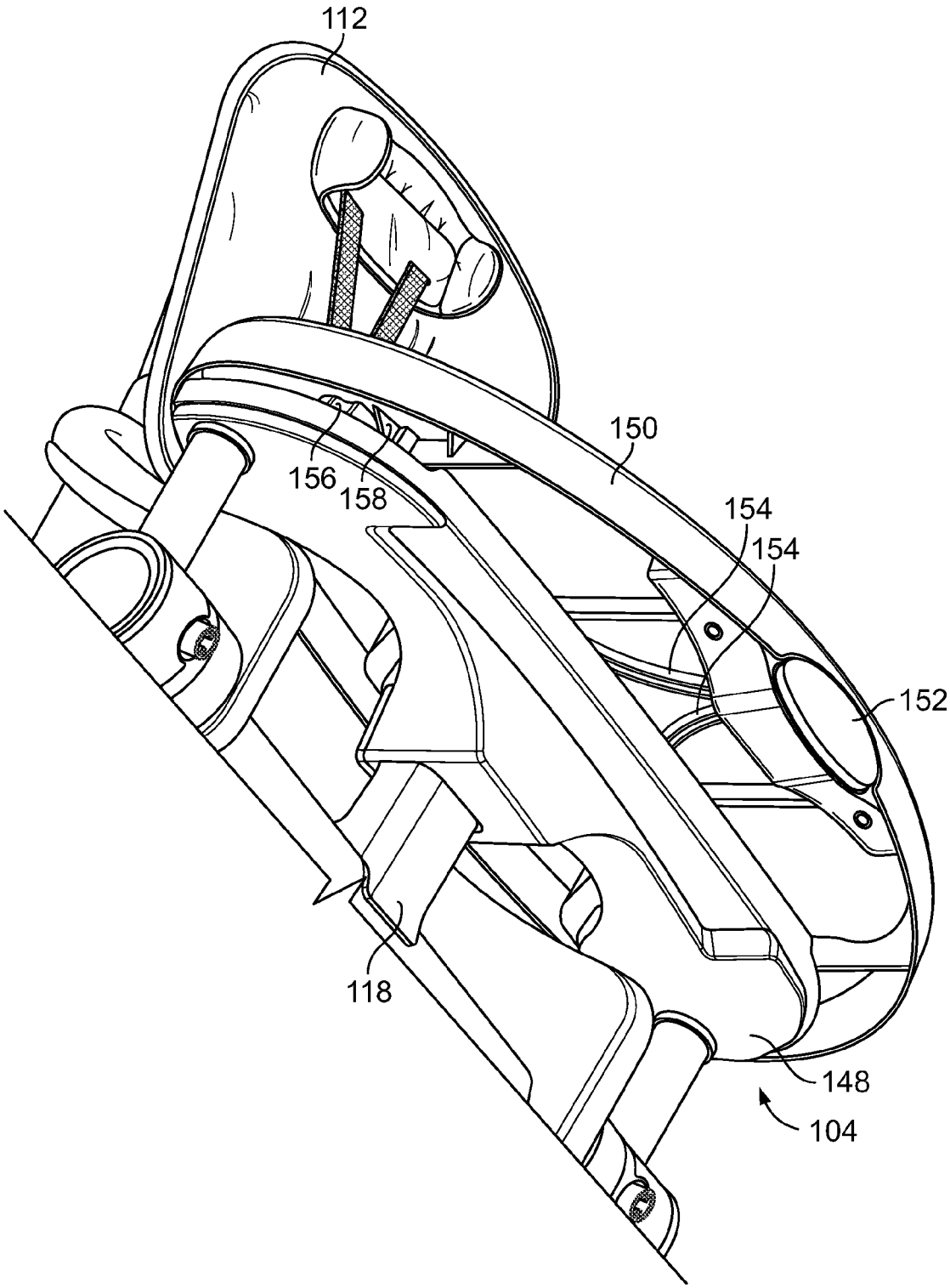
FIG. 9 is a partial perspective bottom view of the example highchair of FIG. 1.
Figure 10:
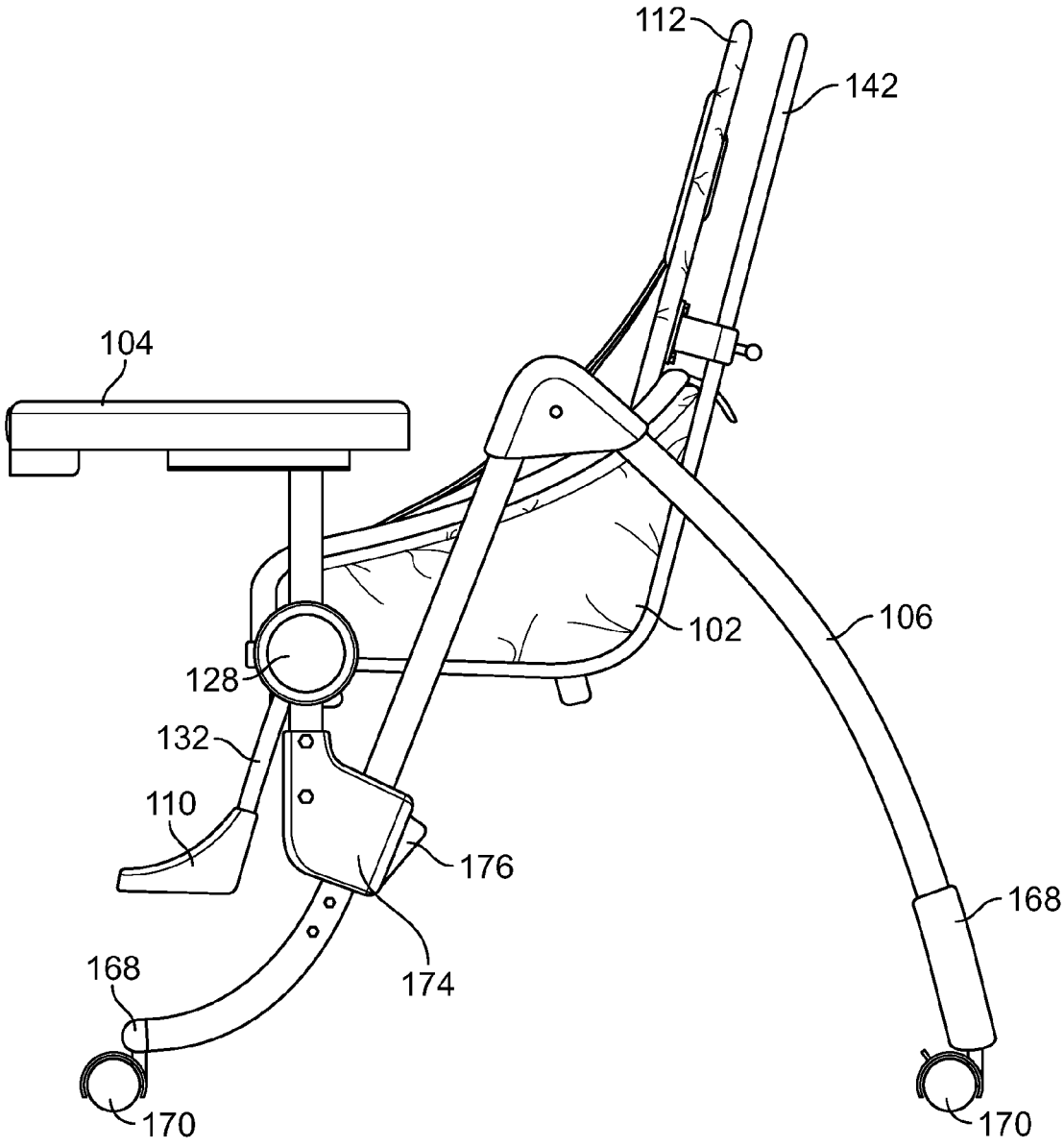
FIG. 10 is a side view of the high chair of FIG. 1, showing the example seat and example tray in a lower position closer to the support surface.

As shown in FIGS. 2, 3, and 9, the example tray 104 includes a base tray 148 and top tray 150. The base tray 148, which is only exposed when the top tray 150 is removed, is permanently affixed to the posts 114, 116 adjacent the front of the seat 102 and may be used in the same manner as the top tray 150 when the top tray 150 is removed (e.g., for holding a child's snacks, meals, drinks, toys, etc.). In addition, the base tray 148 acts as a passive restraint to retain the child in the seat.

The top tray 150 of the illustrated example is laterally adjustable or slidable with respect to the base tray 148. Consequently, the top tray 150 is laterally adjustable with respect to the seat back 112. Therefore, the top tray 150 may be adjusted to accommodate children of varying sizes and/or to provide additional room that may be needed, for example, to remove a child occupying the high chair 100. To adjust the top tray 150 with respect to the base tray 148, a tray actuator 152 is activated. In the illustrated example, the tray actuator 152 is a push button, but any suitable actuating device may alternatively be used. The tray actuator 152 is depressed to disengage the top tray 150 from the base tray 148. The example top tray 150 includes one or more cables or tethers 154 (see FIG. 9). Each tether 154 has a first end and a second end. The first ends of the tethers 154 are coupled to the tray actuator 152. The second ends of the tethers 154 are coupled to a respective clasp 156 (one of which is shown in FIG. 9). Each clasp 156 includes teeth 158 to engage corresponding detents (not shown) on the base tray 148. When the tray actuator 152 is depressed, the tethers 154 move to retract the clasps 156 to thereby cause the teeth 158 to disengage the detents and allow the top tray 150 to slide relative to the base tray 148 and/or to be removed therefrom. The top tray 150 is moveable fore/aft to any number of different positions. In the illustrated example, there are four different positions at which the top tray 150 may be laterally secured relative to the seat back 112. However, other numbers of positions would likewise be appropriate. To fix the top tray 150 in a position relative to the base tray 148, the tray actuator 152 is released to move the tethers 154, extend the clasps 156, and engage the teeth 158 with the detents in the base tray 148.

The tray 104 of the illustrated example also includes a removable insert or liner (not shown) that can be removed for cleaning. Furthermore, the entire top tray 150 may be completely removed from the base tray 148 to, for example, place the top tray 150 and the insert in a dishwasher for cleaning.

As shown in FIGS. 1-3 and 10, the seat 102 and the tray 104 may be moved together to different heights along the frame 106. In the illustrated example, the frame 106 includes one or more front legs 160 and one or more rear legs 162. The front legs 160 and rear legs 162 are coupled via hubs 164 and, in the illustrated example, form an A-frame structure. In the illustrated example, a crossbar 166 couples the front legs 160 to provide lateral stability. Similarly, a second crossbar 166 joins the rear legs 162. Each front leg 160 and rear leg 162 of the illustrated example high chair 100 includes a wheel 170 depending from a foot 168.

Figure 11:
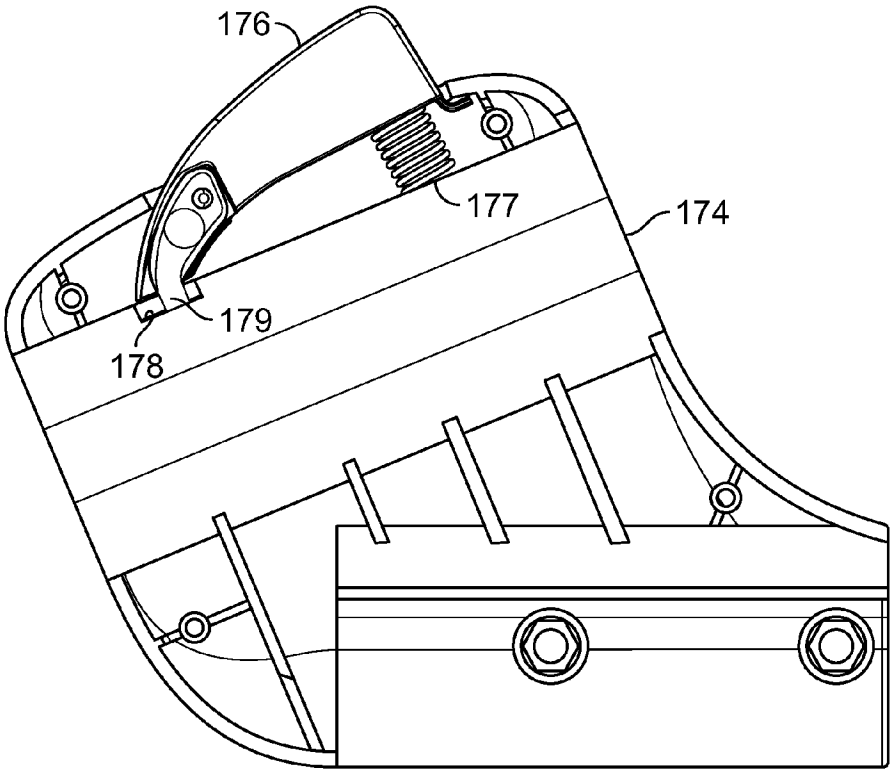
FIG. 11 is a partial cross-sectional view of an example connector used to change the distance between the example seat and tray of FIG. 1 and the support surface.

To moveably cantilever the seat 102 and tray 106 assembly from the frame 106, the first side post 114 is coupled to a third slidable connector 172, and the second side post 116 is coupled to a fourth slidable connector 174. In the illustrated example, the third and fourth slidable connectors 172, 174 are coupled to the front legs 160. However, in other examples, the third and fourth slidable connectors 172, 174 may be coupled to the rear legs 162. Each of the third slidable connector 172 and the fourth slidable connector 174 of the illustrated example includes a height actuator 176. A cross-section of the fourth slidably connector 174 and the height actuator 176 is shown in FIG. 11. In the illustrated example, the height actuators 176 are identical or mirror images of each other. As with the posts 114, 116, each of the front legs 160 includes a plurality of indentations, apertures or holes 178.

To move the seat 102 and the tray 104 with respect to the frame 106, the height actuator(s) 176 are depressed against the force of a bias spring 177 to cause a locking pin 179 to disengage a corresponding one of the plurality of holes 178. The height actuator(s) 176 may operate in a similar manner as the first and second actuators 122, 126 described above. Thus, after the third and fourth slidable connectors 172, 174 are moved to a desired position to adjust the overall height of the seat 102 relative to the floor or other support surface, the height actuator(s) 176 are discharged to engage or reengaged the pin 179 with a corresponding one of the plurality of holes 178 to thereby fix the seat 102 and tray 104 at a position on the frame 106 with respect to a ground or floor upon which the high chair 100 is placed. Four height adjustment positions are shown in the illustrated example. However, any number of height adjustment positions may be included. In addition, the distance of travel between each height adjustment and the overall entire range of travel may be any suitable distance. In the illustrated example, each height adjustment position is one inch from an adjacent height adjustment, and the overall range of travel is ten inches.

Figure 12:
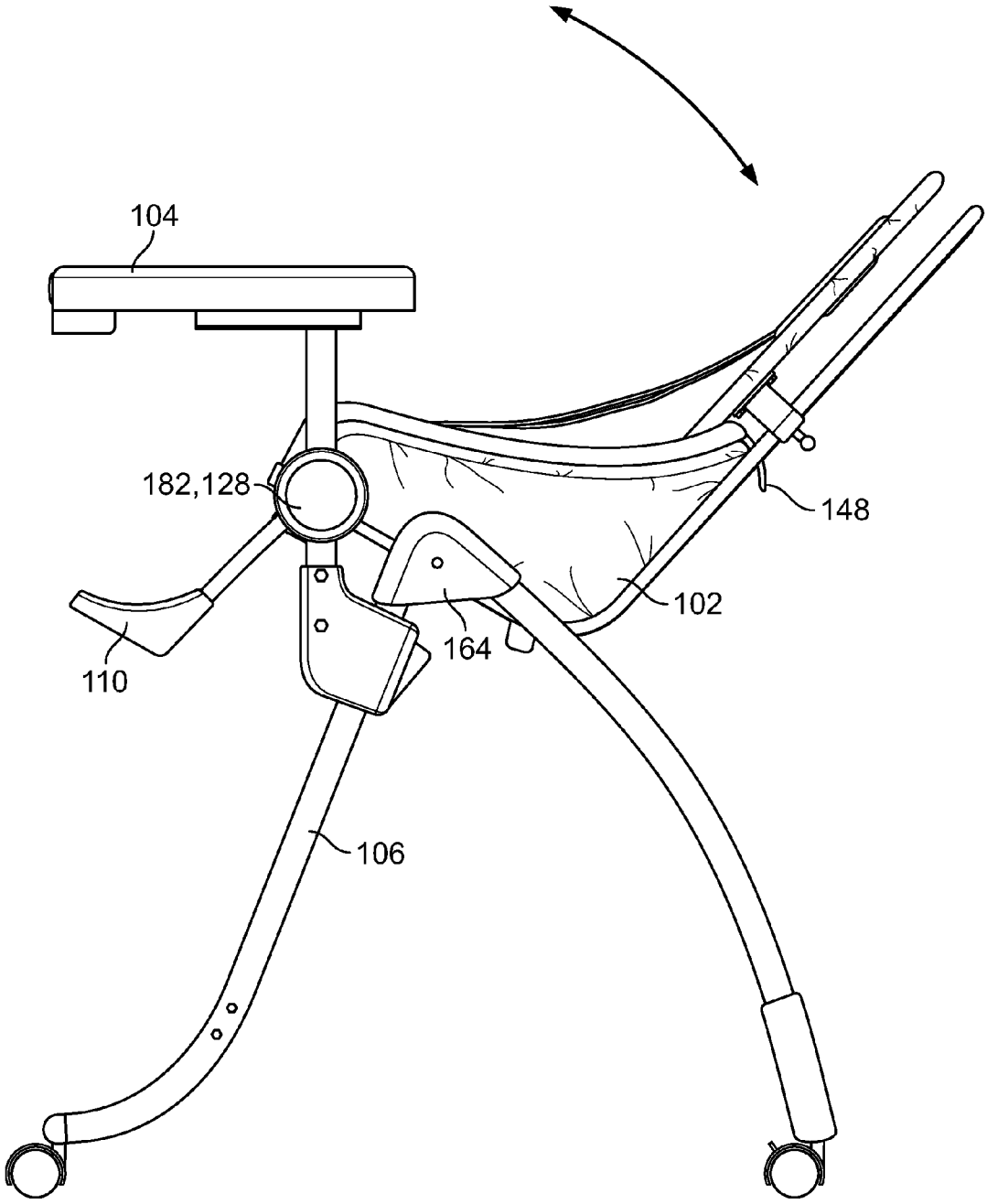
FIG. 12 is a side view of the high chair of FIG. 1 showing the chair in a reclined position with the headrest in a retracted position.

As shown in FIG. 1, the seat 102 of the illustrated example is coupled to the first side post 114 via a first joint 180 and also is coupled to the second side post 116 via a second joint 182. In the illustrated example, the first and second joints 180, 182 are coupled to the first and second slidable connectors 124, 128, respectively. In other examples, the first joint 180 and/or the second joint 182 may be coupled to the first side post 114 and/or the second side post 116 directly, indirectly or otherwise. The joints 180, 182 are also coupled to opposite ends of a crossbar 184 upon which the seat 102 is mounted. The joints 180, 182 enable the seat 102 to recline or rotate with respect to the cross-bar 184, first side post 114, second side post 116, frame 106, tray 104, etc., as shown in FIG. 12.

The joints 180, 182 are substantially identical or mirror images of each other. Thus, in the interest of brevity, only one joint 182 will be described. An exploded view of the joint 182 is shown in FIGS. 13A and 13B. The joint 182 includes an outer, non-rotating or fixed end 186 (also referred to as an outer gear wheel), a cam 188, an inner gear or lock 190 and a rotating-end 192. The non-rotating end 186 includes fixed teeth 194, and the lock 190 includes rotating teeth 196. The rotating end 192 also has complementary teeth 197 (see FIG. 13B). A lever 198 (FIGS. 2, 3, 6 and 12) on the rear of the seat 102 is operatively coupled to the joint 182 by, for example, a cable (not shown) threaded through one or more components of the chair 100 to the joint 182. The lever 198 and/or the cable of the illustrated example is spring loaded. To change the tilt angle of the seat 102, the lever 198 is actuated, which pulls the cable and causes the cam 188 to remove the lock 190 from engagement with the non-rotating end 186 of the joint 182 and move more deeply into the rotating end 192. When the locking rotating teeth 196 are disengaged from the fixed teeth 194, the lock 190 and the rotating end 192, which are coupled via the rotating teeth 196 and the complementary teeth 197, are freely rotatable relative to the fixed end 186. The seat 102, thus, may be moved to a desired angled position. Once the seat 102 is reclined or raised to the desired angle, the lever 198 may be released, which allows a spring 199 to move the lock 190 back into engagement with the non-rotating end 186. In this position, the rotating teeth 196 of the lock 190 engage both the complementary teeth 197 of the rotating end 192 and the fixed teeth 194 of the non-rotating end. This engagement prevents the rotating end 192 from rotating relative to the fixed end 186 and locks the seat 102 in the desired position.

In the illustrated example, the seat 102 has a large number of reclined positions over approximately 32.5° of rotation. The maximum angle of recline for the seat back of the illustrated example is approximately 43°±5°. However, other numbers of positions, other ranges of rotation and/or other maximum angles of recline would likewise be appropriate.

The example high chair 100 also includes a slot 200 in the seat pan 138 as shown in FIGS. 1, 7 and 8. The seat pan 138 is shaped to funnel spilt food, liquids and/or other items to the slot. A catch basin 202 (FIGS. 2, 3, 6, and 8) is removably secured beneath the slot 200 to collect the food, liquid and/or other items that funnel into the slot 200. The catch basin 202 may be removed, emptied and reassembled around the slot 200. Funneling spills through the slot 200 into the catch basin 200 increases the efficiency of cleaning the high chair 100 as less food, liquid and other items are likely to end up on the floor and/or remain in contact with a child seated in the chair 100. The catch basin 202 may be secured adjacent the slot 200 via any suitable means. In the illustrated example, the catch basin 202 is secured to the seat 102 by engaging a ridge 203 that circumscribes at least a portion of the slot, as shown in FIG. 8.

As shown in FIG. 6, the example high chair 100 also includes fold actuators 204, 206. The fold actuators 204, 206 are shown as push buttons but any suitable actuating device may be used as well. The fold actuators 204, 206 are depressed to enable the chair 100 to be folded (FIG. 14) for storage. In the illustrated example, the fold actuators 206, 204 are spring biased to the locked position. Depressing the fold actuators 204, 206 against the force of the springs dislocates corresponding pins (not show) carried by the rear legs from bores (not shown) in the hubs 164 to enable the rear legs 162 to pivot forward. The fold actuators 204, 206, pins and springs may be implemented by, for example, Valco® pins. As shown in FIG. 14, the example high chair 100 is proportioned such that the example high chair 100 stands without assistance, even when the high chair 100 is in the folded position. In the illustrated example, the top tray 150 is removed and attached to the rear of the high chair 100 to make the folded high chair 100 more compact.

The illustrated example high chair 100 includes a restraint or harness 210, as shown in FIGS. 1-3. The harness 210 is shown as two straps that are coupled to the seat back 112 via the headrest 108. In other examples, the harness 210 may be coupled to other portions of the seat back 112. In addition, the straps of the harness 210 may be secured to the seat back via a ring such as, for example, a D-ring or O-ring or via any other suitable mechanical or chemical fasteners. In such an example, D-rings are passed through the openings in the seat back 112 in a first orientation and positioned in a second orientation behind the seat to prevent removal of the harness straps from the seat back 112. In the illustrated example, the material of the harness 210 is sewn onto itself, for example, in the shape of a 'T' on the rear side of the seat back 112 to prevent retraction through the opening. Because the seat back 112 is height adjustable and the harness 210 passes through the seat back 112, the position of the harness 210 can be easily adjusted by adjusting the height of the seat back 112. The harness 210 in the illustrated example is attached to the crotch post 118 via a clip to form a three-point harness. In other examples, the harness 210 may be coupled to the crotch post 118 via a T- or Y-shaped shield or plate to form a five-point harness.

In an alternative example a three point harness that acts like a five point harness is provided. This harness (referred to as a pseudo 5-point harness) includes three solid points and two soft points of attachment. The three solid points are the fixed connections between the belts of the harness and the seat 102 of the high chair 100 at the seat back 112 with the D-rings and the crotch post 118. Thus, two of the fixed points are located above the shoulders of the child. The third fixed point is located at the crotch post 118. A Y-shaped connector is included in the pseudo 5-point harness. The Y-shaped connector has a latch on the bottom of the Y that secures into a latch fixed to the crotch post 118. The wings of the Y-shaped connector are positioned and dimensioned to resiliently engage opposite side walls of the slick foam seat 102 to form two friction fit locks—one on each side of the child, thereby forming the two soft attachment points noted above. The two soft points are friction fit points.

Returning to the example of FIG. 1, as a result of the adjustability of the seat back 112, the seat back 112 need only be provided with two shoulder apertures or holes 212 for the harness 210, instead of a series of holes to raise or lower the harness 210 as the child grows. Instead, the height of the seat back 112 can be adjusted so that the shoulder belts of the harness 210 are positioned properly relative to the child. The shoulder height of the child harness 210 is automatically adjusted as the seat back 112 is moved to properly locate the headrest 108 for the child, so there is no need for multiple openings on the seat back for the harness 210 to pass through. In the illustrated example the height of the seat back 112 is infinitely adjustable within an approximately 6 inch range of travel. Other approaches such as employing a number of fixed positions and/or other ranges of travel would likewise be appropriate.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

We claim:

1. A high chair comprising:

a frame;

a seat, wherein the seat defines a slot and is shaped to funnel spills toward the slot; and a catch basin removably secured beneath the slot.

2. A high chair as defined in claim 1, wherein the frame is structured to stand upright when folded.

3. A high chair as defined in claim 1, further comprising:

a crossbar carrying at least one of the seat and the tray, and a footrest coupled to the cross-bar via an extension, the footrest being adjustable along a length of the extension.

4. A high chair as defined in claim 1, further comprising a crossbar carrying the seat, the seat being rotatably coupled to the crossbar.

5. A high chair comprising:

a frame;

a seat, wherein the seat defines a slot and is shaped to funnel spills toward the slot; and a crossbar carrying the seat, the seat being rotatably coupled to the crossbar, wherein the seat is rotatably coupled to the cross bar by a joint, the joint comprising:

an inner gear wheel;

an outer gear wheel engageable with the inner gear wheel to lock the seat against rotation relative to the crossbar; and a cam, the cam being actuatable to disengage the inner gear wheel and the outer gear wheel to release the seat for rotation relative to the crossbar.

6. A high chair as defined in claim 5, further comprising a lever to actuate the cam.

7. A high chair as defined in claim 6, wherein the lever is disposed on a rear of the seat.

8. A high chair as defined in claim 1, wherein the seat further comprises:

a seat pan;

a seat back; and a post to adjustably couple the seat back to the seat pan.

9. A high chair as defined in claim 8, further comprising an actuator coupled to the seat back to selectively release the seat back for movement relative to the post.

10. A high chair as defined in claim 1, wherein the seat comprises a slick foam.

11. A high chair as defined in claim 1, further comprising a fabric support for the seat.

12. A high chair as defined in claim 1, further comprising a ridge circumscribing at least a portion of the slot, wherein the catch basin is removably coupled to at least a portion of the ridge.

13. A high chair as defined in claim 12, wherein the catch basin is slidably coupled to the ridge.

14. A high chair comprising:

a frame;

a seat, wherein the seat defines a slot and is shaped to funnel spills toward the slot; and a fabric support for the seat, wherein the fabric support includes an opening and wherein at least one of a ridge or the catch basin extend through the opening.

15. A high chair as defined in claim 1, wherein the seat is shaped downward to the slot.

16. A high chair as defined in claim 1, wherein the slot is in a rear portion of the seat.

17. A high chair as defined in claim 1, wherein the slot is in a curved portion of the seat.

18. A high chair as defined in claim 1, wherein the seat has a top surface and the slot is formed in the top surface with no intervening structure between the top surface of the seat and a center of the slot.

19. A high chair comprising:

a frame;

a seat, wherein the seat defines a slot and is shaped to funnel spills toward the slot, wherein the seat has a top surface and the slot is formed in the top surface with no intervening structure between the top surface of the seat and a center of the slot; and a ridge integrally formed with the seat around the slot on a surface opposite the top surface.

* * * * *